US007487560B2

(12) United States Patent
McGrath et al.

(10) Patent No.: US 7,487,560 B2
(45) Date of Patent: Feb. 10, 2009

(54) EASILY CHANGEABLE ABSORBENT PANEL FOR BED CLOTHING

(76) Inventors: Deborah McGrath, 4541 Holiday Heights Dr., Oakwood, GA (US) 30566; Yvonne Goldman, 6016 River Oaks Dr., Flowery Branch, GA (US) 30542

( * ) Notice: Subject to any disclaimer, the term of this patent is extended or adjusted under 35 U.S.C. 154(b) by 167 days.

(21) Appl. No.: 10/336,729

(22) Filed: Jan. 6, 2003

(65) Prior Publication Data

US 2004/0128764 A1 Jul. 8, 2004

(51) Int. Cl.
*A47G 9/02* (2006.01)
*A47C 21/02* (2006.01)

(52) U.S. Cl. ..... 5/488; 5/484; 5/498

(58) Field of Classification Search ..... 5/482, 5/484, 488, 495, 496, 498, 499
See application file for complete search history.

(56) References Cited

U.S. PATENT DOCUMENTS

| | | | | | |
|---|---|---|---|---|---|
| 819,903 | A | | 5/1906 | Maussner | |
| 2,162,021 | A | * | 6/1939 | Kidwell | 5/694 |
| 2,400,731 | A | | 5/1946 | Armstrong | |
| 2,789,292 | A | * | 4/1957 | Budinquest | 5/486 |
| 2,907,055 | A | * | 10/1959 | Berman | 5/496 |
| 3,027,573 | A | | 4/1962 | Bell, Jr. | |
| 3,066,321 | A | * | 12/1962 | Kintner | 5/498 |
| 3,179,958 | A | | 4/1965 | Carris | |
| 3,242,508 | A | * | 3/1966 | Smithson | 5/502 |
| 3,273,177 | A | | 9/1966 | Newton | |
| 3,308,488 | A | * | 3/1967 | Schoonman | 5/495 |
| 3,384,908 | A | | 5/1968 | Janopol | |
| 3,427,670 | A | * | 2/1969 | Nimoy | 5/500 |
| 3,530,487 | A | * | 9/1970 | Beer | 5/496 |

(Continued)

FOREIGN PATENT DOCUMENTS

| | | | | |
|---|---|---|---|---|
| CH | 612 338 | * | 7/1979 | 5/498 |

(Continued)

OTHER PUBLICATIONS

"Quick Zip® Crib Sheet." One Step Ahead®, 2001.

(Continued)

*Primary Examiner*—Michael Safavi
(74) *Attorney, Agent, or Firm*—Buchanan Ingersoll & Rooney PC

(57) ABSTRACT

The securing layer such as a fitted sheet is modified to provide one half of a fastener, such as a zipper, and a separable, absorbent panel as adapted to overlay the top surface of a mattress and to underlay and be in direct contact of the occupant on the mattress. The separable, absorbent panel includes another fastener portion, such as the other side of a zipper, so as to secure the absorbent panel to the securing layer. The first and second fastener portions are to be located on the side surface of the mattress at the top, outer circumference of the mattress when the securing layer is applied to the mattress. In this manner, the fastener cannot be easily accessed by an infant so as to prevent the infant from loosening and becoming entangled in the absorbent panel. However, the absorbent panel is easily removed for quick changes in case the occupant of the mattress, such as a baby, soils the absorbent panel.

8 Claims, 2 Drawing Sheets

U.S. PATENT DOCUMENTS

| | | | | | |
|---|---|---|---|---|---|
| 3,570,026 | A | * | 3/1971 | Allison | 5/496 |
| 3,581,322 | A | | 6/1971 | Marsico | |
| 3,591,875 | A | | 7/1971 | Zipf, III | |
| 3,761,973 | A | * | 10/1973 | Leventhal | 5/484 |
| 3,801,420 | A | * | 4/1974 | Anderson | 5/502 |
| 3,845,513 | A | | 11/1974 | Hubner | |
| 3,965,503 | A | * | 6/1976 | Gridel | 5/484 |
| 3,965,504 | A | * | 6/1976 | Ainsworth | 5/485 |
| 4,015,457 | A | * | 4/1977 | Fukuroi | 70/68 |
| 4,064,577 | A | | 12/1977 | Walters | |
| 4,097,943 | A | * | 7/1978 | O'Connell | 5/484 |
| 4,301,561 | A | | 11/1981 | McLeod | |
| 4,317,244 | A | | 3/1982 | Balfour-Ritchie | |
| D267,696 | S | | 1/1983 | Adams | |
| 4,388,738 | A | * | 6/1983 | Wagner | 5/738 |
| 4,488,323 | A | * | 12/1984 | Colburn | 5/692 |
| 4,546,508 | A | | 10/1985 | Ison | |
| 4,809,375 | A | | 3/1989 | Bull | |
| 4,875,245 | A | * | 10/1989 | Isola | 5/482 |
| 4,899,408 | A | | 2/1990 | Illingworh | |
| 4,922,565 | A | | 5/1990 | Blake | |
| 5,003,655 | A | | 4/1991 | Kafai | |
| 5,005,236 | A | | 4/1991 | Hutchison | |
| 5,042,099 | A | * | 8/1991 | Brenner et al. | 5/502 |
| 5,086,530 | A | | 2/1992 | Blake | |
| 5,090,074 | A | | 2/1992 | Scales et al. | |
| 5,092,010 | A | | 3/1992 | Wong | |
| 5,133,097 | A | | 7/1992 | Pyles | |
| 5,134,736 | A | | 8/1992 | Anthony et al. | |
| 5,136,741 | A | * | 8/1992 | Balonick et al. | 5/922 |
| 5,144,911 | A | | 9/1992 | Moore et al. | |
| 5,208,926 | A | | 5/1993 | Stackhouse | |
| 5,285,542 | A | * | 2/1994 | West et al. | 5/502 |
| 5,289,602 | A | | 3/1994 | Trader | |
| 5,335,383 | A | | 8/1994 | Schwind | |
| 5,546,508 | A | | 8/1996 | Jain et al. | |
| 5,557,814 | A | | 9/1996 | Cybulski | |
| 5,566,411 | A | | 10/1996 | Eiler | |
| 5,572,754 | A | | 11/1996 | Lazar et al. | |
| 5,577,276 | A | | 11/1996 | Nicholson et al. | |
| 5,638,562 | A | | 6/1997 | Masoncup | |
| 5,664,269 | A | * | 9/1997 | Broder | 5/496 |
| 5,666,680 | A | * | 9/1997 | Hackett, Jr. | 5/496 |
| 5,701,617 | A | | 12/1997 | Colby | |
| 5,884,338 | A | * | 3/1999 | Golde | 2/247 |
| 5,946,751 | A | | 9/1999 | DeMay | |
| 5,970,543 | A | | 10/1999 | Barreca et al. | |
| 6,006,383 | A | | 12/1999 | Pile et al. | |
| 6,009,574 | A | | 1/2000 | Moreland | |
| 6,122,783 | A | | 9/2000 | Herndon et al. | |
| D433,865 | S | | 11/2000 | Willbanks | |
| 6,233,762 | B1 | * | 5/2001 | Bradley | 5/484 |
| 6,243,895 | B1 | | 6/2001 | Amin | |
| 6,381,778 | B1 | | 5/2002 | Peterson | |
| 6,490,741 | B1 | * | 12/2002 | Wheeler | 5/498 |
| 6,618,881 | B2 | * | 9/2003 | Hart et al. | 5/502 |
| 6,631,529 | B1 | | 10/2003 | Erickson | |
| 6,651,278 | B2 | * | 11/2003 | Ghanem | 5/496 |
| 2002/0148047 | A1 | | 10/2002 | Corzani et al. | |
| 2003/0000014 | A1 | | 1/2003 | Sopher et al. | |
| 2003/0070232 | A1 | | 4/2003 | Diak/Ghanem | |
| 2003/0177579 | A1 | * | 9/2003 | Diak/Ghanem | 5/499 |

FOREIGN PATENT DOCUMENTS

| | | | |
|---|---|---|---|
| WO | 01/97867 | A1 | 12/2001 |
| WO | 03001868 | A2 | 1/2003 |

OTHER PUBLICATIONS

"Zip Sheets®." Diggle Do, 2001. ww.baby-place.com.

* cited by examiner

EASILY CHANGEABLE ABSORBENT PANEL FOR BED CLOTHING

FIELD OF THE INVENTION

The present invention relates to bed clothing with means for facilitating the changing of panel thereof.

DESCRIPTION OF THE RELATED ART

As parents of young children are aware, infants tend to soil sheets on a regular basis. This necessitates the changing of sheets, which for a crib is inconvenient insofar as the end walls and side rails of the crib tend to make this process more difficult. The end walls 12, 14 and side rails 16,18 of the crib 10 as illustrated in FIG. 1 restrict the movement of caregiver's hands adjacent to the mattress 20. The tight fit between the mattress 10 and the end walls 12, 14 and side rails 16, 18 is deliberate. A caregiver does not want an infant to inadvertently or through exploration activities have a limb trapped in the space between the mattress 20 and rails 14, 16 insofar as this can cause severe injury to the child. Because of this tight fit, to change a sheet it is often necessary to completely or halfway lift the mattress out of the crib. The process is inconvenient, sometimes physically uncomfortable, strenuous and aggravating, particularly in the early morning hours. It also disturbs the child because the child must be removed from the crib in order to change the sheets.

Similar problems occur in any bed when they have adjacent structures, such as the side rails on hospital beds, which make it inconvenient for the caregivers to change the sheets when a patient for instance soils them. Even without adjacent structures, changing flat, fitted or encasement sheets can be inconvenient because generally at least part of the mattress is lifted. Also, because of the moisture content of the soiling agents, such as vomit, body fluids, fecal matter and urine, that penetrates through to the under sheet, it is often also necessary to change the mattress pad that is conventionally placed between the undersheet and the mattress.

Many solutions have been proposed to solve this problem but each suffers from one or more perceived defects. For instance, the U.S. Pat. Nos. 4,922,565 and 5,086,530 to Blake disclose a composite sheet, which includes a first upper panel that has a moisture proof element such as plastic or rubber, and a second panel that is fitted over the mattress. However, the moisture proof upper panel is adhered to the lower panel via a hook and loop fasteners commonly referred to as a VELCRO® fastener placed on the topside of the mattress on the lower sheet. The problem with the structure is twofold. First, a child can pull the moisture proof panel off the lower panel and become entangled in it. Children have been known to suffocate when wrapped tightly in a sheet loosened from a crib mattress. While the Blake patents disclose the edge of the waterproof panel as placed underneath bumper pads, a curious infant would nevertheless be able to not only find the edge of the panel, but the edge of the panel provides finger holds so that an child, particularly a toddler, could remove it from its Velcro fasteners.

Additionally, some attempts have been made to improve upon the Blake structure such as providing VELCRO® fastener panels that extend down the sides of the mattress. See U.S. Pat. No. 6,243,895 to Amin. However, this approach leads to the same problem as with conventional sheets insofar as it is likely necessary that the mattress pad be at least partially removed from the crib in order to secure the VELCRO® fasteners to the sides of the mattress, for instance.

The U.S. Pat. No. 3,570,026 to Allison discloses a baby bed sheet with a removable panel where two zippers are placed on the top surface of the mattress. As with the VELCRO® fastener embodiment of the Blake patent, a hazard to this structure is that a curious baby could unzip the removable panel. The zipper location also creates a bit of a bump in the mattress surface. Further, as disclosed in the Allison patent, there are two zippers, which requires greater assembly because each zipper has to be started and zipped separately. The Allison patent discloses that an overlay of fabric can be provided with snaps or hooks fasteners to keep the curious hands of the child away from the zipper slider. Because the snaps are not out of the convenient reach of an infant, it is believed that an infant may be able to defeat these measures as well. In any event, the location of the zipper presents the zipper to curious hands and the fact that the zipper is located on and under the surface of the removable panel means that the panel has finger holds for the child to grasp and tug on, which can cause the inadvertent separation of the zipper, even when the slider is not used. In any event, it is believed that the Allison baby sheet imposes an unacceptable risk and discomfort to the occupant of the bed. A similar structure is used with a continuous zipper in U.S. Pat. No. 5,289,602 to Trader. There are several other examples of bed sheets which use hook and loop fasteners and the like such, as U.S. Pat. No. 5,003,655 to Kafai, U.S. Pat. No. 5,577,276 to Nicholson et al. and WO 01/79867. Additionally, there are a variety of mechanisms for securing sheets, in general, to a bed. See U.S. Pat. No. 6,122,783 to Herndon et al. and U.S. Pat. No. 4,546,508 to Ison, for instance.

Other solutions, such as the U.S. Pat. No. 3,530,487 issued to Beer, which is bedclothes designed to make a bed more readily made up and not specifically designed for cribs, includes zippers which apply an under sheet that is in direct contact with the occupant at a location about midway down the mattress. However, this solution does not work well in a crib environment or any bed that has obstructions adjacent to the mattress insofar as the mattress would still have to be lifted above the obstruction. A problem associated with this location of this zipper is that it is difficult for someone changing the sheet to reach past the side walls 12 and 14 and side rails 16 and 18 of a crib, or like a bed with obstructions adjacent with the sides of the mattress. It generally becomes necessary for the person desiring to change the sheet to lift the mattress high enough off the bed to clear any adjacent obstructions in order to unzip it. This is inconvenient, particularly when it is desired that the occupant such as a baby not be woken during the process and more particularly in the early hours of the morning when it often becomes necessary to change the sheets of a baby's crib. Also, the bed pad is underneath the under or bottom sheet. Therefor, if the bed is sufficiently soiled, it is necessary to remove not only the under sheet, but the mattress pad, leading to greater inconvenience.

However, it is also equally inconvenient for a zipper to be on the top of the matter such as done for waterbed sheets because infants are likely to find and play with, perhaps to their detriment, the zipper, as explained above. Also, the location of the zipper on the top surface of the bed can be inconvenient and uncomfortable particularly in the hospital environment where the patients may be asked to slide across the zipper portion in getting in or out of bed.

SUMMARY OF THE INVENTION

It is an object of the present invention to provide bed clothing which includes a securing layer such as a fitted sheet of material adapted to be in direct contact with the top and side surfaces of a mattress. It further includes a separable insert panel that may be absorbent in certain embodiments and is adapted to overlay all the top surface of the mattress and to underlay and be in direct contact with an occupant of the bed on the mattress. Embodiments of the present invention further provides a continuous, separable fastener, such as a zipper, which includes first fastener portion mounted to an outer periphery of the insert panel and a second fastener portion mounted to a securing layer being located on the side surfaces of the mattress and a top, outer circumference of the mattress when the securing layer is applied to the mattress. The first and second fastener portions are opposed, elongated and cooperating configured surfaces intended to directly contact and interlock with each other in a single plane. In this manner, movement between the securing layer and the absorbent panel is restricted in the direction forces transmitted between the absorbent panel and the securing layer. The first fastener portion and the second fastener portions are easily associated and disassociated, as would be expected with a zipper.

Other aspects of the present invention will be described in the following text.

BRIEF DESCRIPTION OF THE DRAWING FIGURES

The present invention will now be described by way of exemplary embodiments to which it is not limited with reference to the accompanying drawing figures.

DETAILED DESCRIPTION OF THE INVENTION

Figure 1:
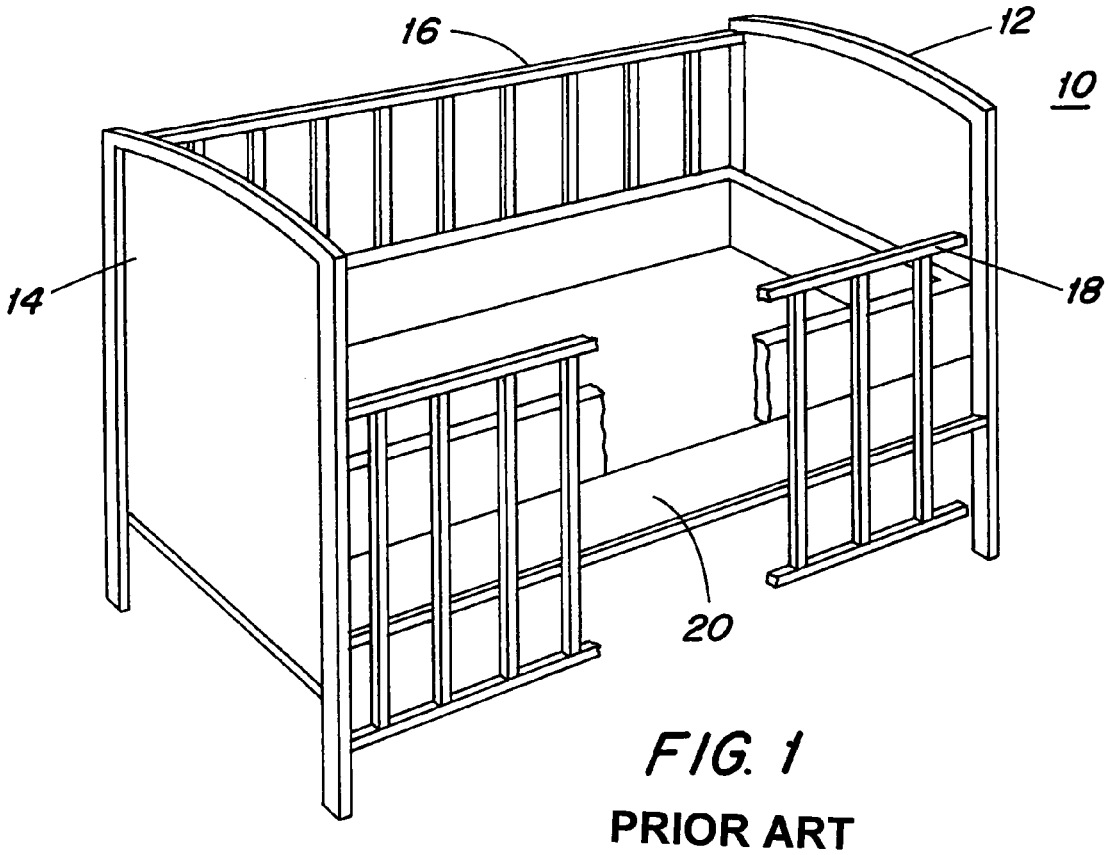
FIG. 1 PRIOR ART
FIG. 1 is a perspective view of a conventional baby crib.

As illustrated in FIG. 1, a baby's crib 10 includes an enclosure defined by fixed sides 12 and 14 and side rails 16 and 18. A mattress is placed between the fixed walls 12 and 14 and side rails 16 and 18 so as to provide very little gap between the mattress and the walls and rails. A frame (not labeled) supports the mattress. Typically, bumper pads (not labeled) are positioned around the inner surface of the fixed walls 12 and 14 and side rails 16 and 18 above and adjacent to the top surface of the mattress so to reduce the possibility of a baby bumping his or her head.

Figure 2:
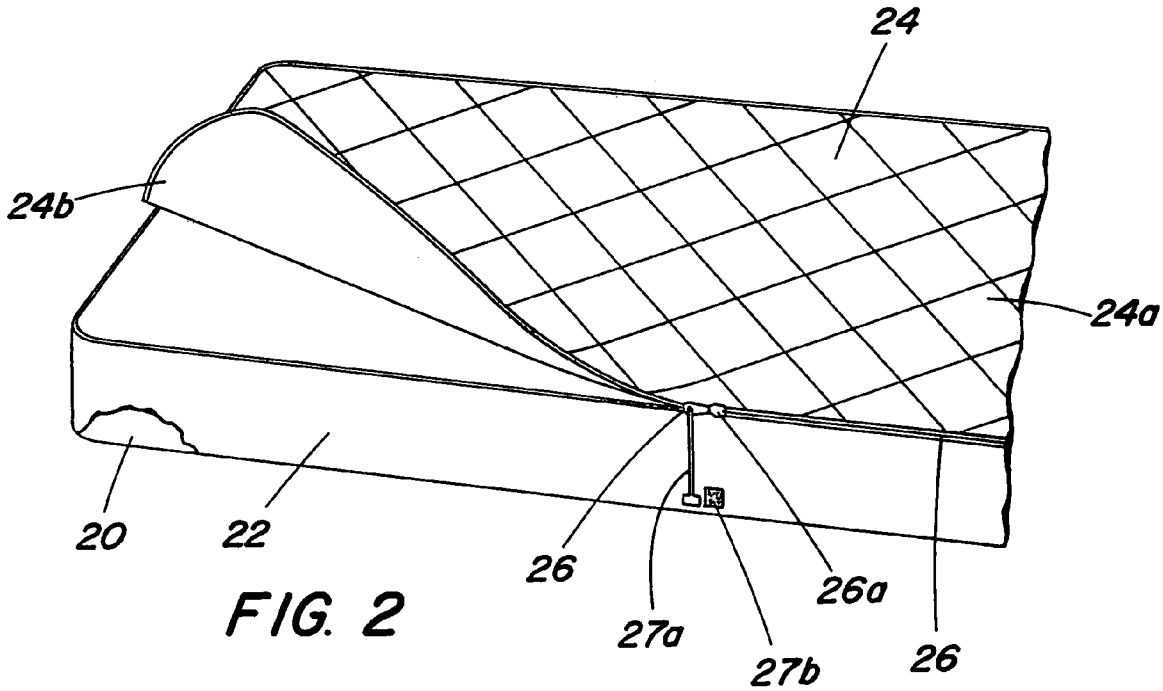
FIG. 2 is a perspective view of one embodiment of the present invention.
Figure 3:
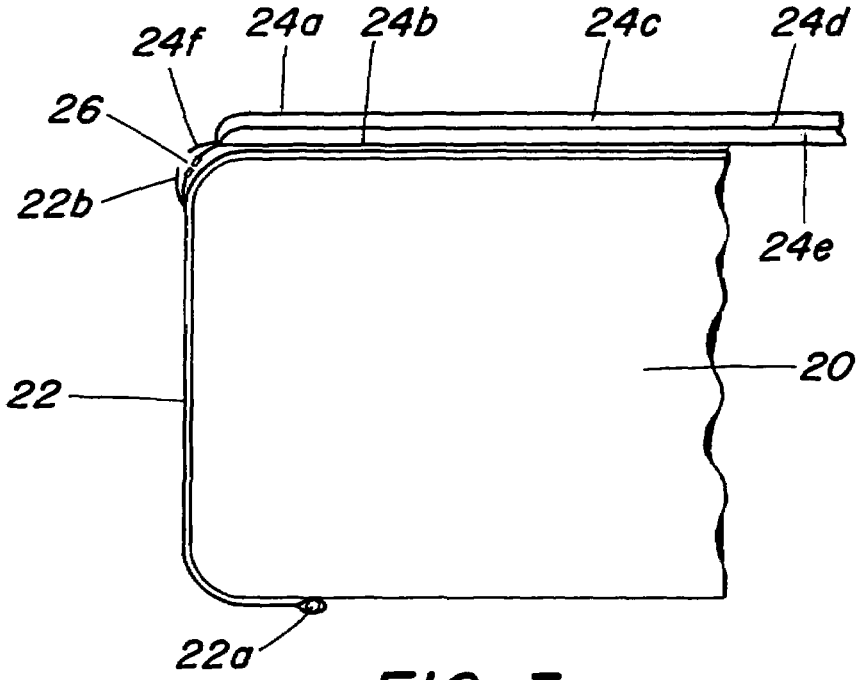
FIG. 3 is a sectional view of one embodiment of the present invention on a mattress.
Figure 4:
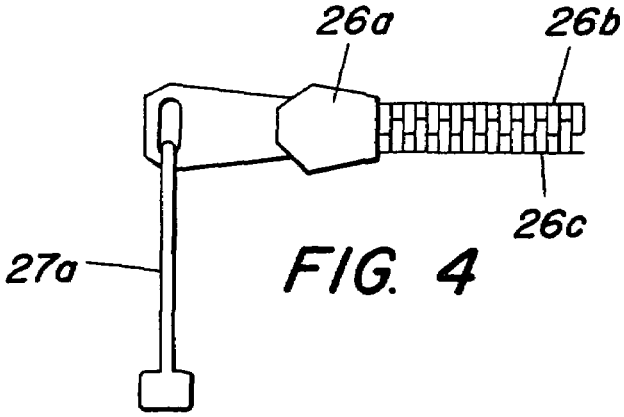
FIGS. 4 and 5 are detailed views showing embodiments of a slider of the fastening means.

As illustrated in FIGS. 2 and 3, the present invention includes a securing layer 22 of material adapted to be in directed contact with the top surface and side surfaces of mattress 20. The securing layer 22 can take the form of a modified fitted sheet which includes at least one corner and preferably four corners which are preformed to surround the corner of a mattress. On the outer edge of the fitted sheet an elastic band 22*a* is generally provided to provide a smooth and secure fit to a mattress 20. Hence, securing layer 22 covers all four sides on the top surface of the mattress 20. As an alternative, an encasement sheet can be used as part of the securing layer 22 in which all four sides, the top and the bottom of the mattress are covered. In yet another embodiment of the present invention, the securing layer 22 can be simply a loop of material covering only the four sides of the mattress and secured into location, by, for instance, by elastic bands on both sides of the loop of material, such a found on a fitted sheet. It should also be noted that either the surfaces covering the top and bottom of the mattress 20 can have an insert of mesh material to permit greater movement of air and/or can be made out of relatively inexpensive materials insofar as this securing layer 22 does not have to come into contact with the occupant of the bed, as will become apparent in the description below.

The present invention also can include a separable insert panel 24 adapted to overlay all the top surface of the mattress 20 and to underlay and be in direct contact with the occupant on the mattress 20 and can be absorbent in various embodiments of the invention. The insert panel 24 includes a top surface 24*a* and a bottom surface 24*b*. The insert panel 24 also may include at least one absorbent layer 24*c* and a moisture restriction layer 24*d*. The moisture restriction layer 24*d* is not always necessary particularly on adult oriented products because cognizant adults can ask that a soiled absorbent panel 24 be replaced quickly. When the absorbent panel 24 is placed on the mattress 20, an occupant is in direct contact with the absorbent layer 24*c*. In an alternative, the absorbent panel 24 can include a second absorbent layer 24*e* positioned on the side opposite to the first absorbent layer 24*c* relative to the moisture restriction layer 24*d*.

The moisture restriction layer 24*d* can in one embodiment resist moisture from passing there through, but not completely block moisture as far as in some circumstances moisture does not seep through the absorbent layer 24*c* and the moisture resistant layer 24*d* before the absorbent panel 24 is reasonably expected to be replaced. Moisture resistant material can be advantageous insofar as it can permit the passage of minor amounts of moisture out of the mattress or away from the occupant, for instance, which may be desirable.

Alternatively, the moisture restriction layer 24*d* can prevent moisture from passing therethrough, thereby providing maximum protection to the mattress. Additionally or alternatively, the moisture restriction layer 24 can permit air to pass there through which may be viewed as healthy for the occupant, e.g., baby, insofar as there is some indication that crib death is caused through some as yet unidentified suffocation mechanism.

In certain embodiments the absorbent panel 24 is washable for reuse, but it is also possible that the absorbent panel 24 be disposable after a single soiling. A disposable absorbent panel 24 might be advantageous in some circumstances such as hospitals or anywhere the soiling agent may constitute a biohazard, for instance. If disposable, it is envisioned that the absorbent panel 24 could be have a structure similar to the layered structure of a diaper including a moisture or liquid permeable layer, an absorption layer, and a moisture resistant or impermeable layer, the latter acting as the moisture restriction layer 24*d* as described above.

Additionally, particularly in the embodiment which uses first and second absorbent layer 24*c*, 24*e* with the moisture restriction layer 24*d* interposed there between, the absorbent layers 24*c*, 24*e* can have applied decorative designs. In a more preferred embodiment, the decorative designs would be different from each other so as to provide the user with the option of which decorative design is exposed for coordination with room decorations, for instance. In this way, the first absorbent layer 24*c* of the two absorbent layer embodiment be in direct contact with the occupant of the mattress when the absorbent panel 24 is oriented one way, whereas the second absorbent layer 24*e* is in direct contact with the occupant on the mattress 20 when the absorbent panel 24 is oriented another way, i.e., flipped over. The moisture restriction layer 24*d* would be interposed between the first absorbent layer 24*c* and the second absorbent layer 24*e*. The absorbent panel 24 may be embossed with a pattern on at least one and optionally both sides.

It is noted at this point that the absorbent panel 24 may be adapted to overlay all of and extend beyond the top surface of the mattress 20, for reasons which will become apparent in conjunction with the description of the continuous separable fastener 26.

The continuous, separable fastener 26 can be in the form of a zipper with a slide 26 or similar mechanism (e.g., a Zip Lock® fastener). The continuous, separable fastener 26 includes a first fastener portion 26*b* mounted to an outer periphery of the absorbent panel 24 and a second fastener portion 26*c* mounted to the securing layer 22 such that it is located on the side surfaces of the mattresses 20 at the top, outer circumference of the mattress when the securing layer 22 is applied to the mattress 20.

The continuous separable fastener 26 includes a first and second fastener portions 26*b* and 26*c* which are opposed, elongated cooperating configured surfaces intended to directly contact and interlock with each other without overlapping which is required by VELCRO® fasteners and the like. The movement between the securing layer 22 and the absorbent panel 24 is restricted in the direction of force, by the pulling motion of the fabric, which is transmitted between the securing layer 22 and the absorbent panel 24. The first fastener portion 26*b* and the second fastener portion 26*c* are always usually associated and disassociated from each other, as it is typical of a zipper, or the like.

The zipper may be covered by tabs of fabric 22*b* and 24*f* associated with the securing layer 22 and absorbent panel 24, respectively to not only reduce the likelihood that an infant will find the zipper, but also provide greater comfort in environments where the bed occupant may be asked to slide across the zippered surface in getting in or out of bed.

While the tabs 22*b* and 24*f* provide some protection from disassociating the first fastener portion 26*b* from the second fastener portion 26*c*, an additional measure can be taken which is the slider 26*a* is secured against movement by a young child occupant. This mechanism can take the form of a lanyard with one end secured to the slider 26*a* and the other end including means for securing it to a fixed object. For instance, the other end of the lanyard may include VELCRO® fasteners, hooks, loops, buttons, etc. for fastening to either a lower portion of a mattress 20 or to the securing layer 22, as illustrated in FIG. 2 at location 27*b*, or to a side rail 16, 18 or end walls 12,14. It should be noted that a preferred location for the continuous separable fastener to end its movement in a fastened state is at a midpoint at the head or foot of the bed for embodiment intended for adult size beds and at a midpoint of any side for a product intended for a crib mattress 20, in light of the ease in changing the separable panel 24 while the bed remains occupied, as explained below.

It should be noted that a preferred location for the slider 26*a* of the continuous separable fastener 26 to end its movement in a fastened state is at a midpoint at the head or foot of the bed for embodiment intended for adult size beds and at a midpoint of any side for a product intended for a crib mattress 20, in light of the ease in changing the separable panel 24 while the bed remains occupied, as explained below.

Alternatively, the continuous separable fastener 26 can include two sliders 26*a*, as is known in the zipper art, and the lanyard 27*a* interlock the apertures thereof through a mechanism which is likely to defeat the efforts of an infant disassociating the two fastener portions 26*b* and 26*c*. The end of the lanyard 27*a* can take the form of a simple lock, latch or other structure easily released by an adult, not easily released by a child. The lanyard 27*a*, as mentioned above, can also simply be fastened to itself by looping it around the spoke in one of the rails 16, 18 and back on to itself, again using a mechanism such as a snap, button, VELCRO® fastener, knotting or other mechanism for securing the lanyard, and therefore the slider, against movement by an infant. For added security, it is best of the securing mechanism at the end of the lanyard 27*a* be out of the convenient reach of the child occupant.

Figure 5:
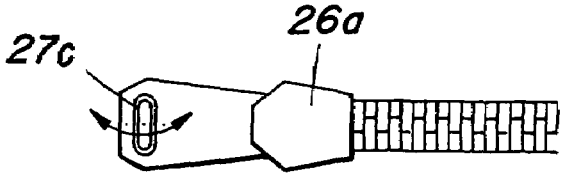

As an alternative to the lanyard 27*a*, the slider 26*a* can include an aperture into which is fit a rotatable clasp head 27*c*, such as found on purses and the like, as shown in FIG. 5. Hence, when the zipper is in its fully zipped position, the head can be flipped over such that the clasp head 27*c* projects through the aperture of the slider 26 and can be rotated about a pivot point such that the head 27*c* secures the slider handle in a locked position. The locked position of the clasp head 27*c* can be secured by means of detents in the slider handle adjacent to the aperture, for instance. The clasp head 27*c* can be mounted on the securing layer 22, or on another slider 26*a* in a two slider 26*a* embodiment (wherein a zipper for instance has two heads rather than the more common head and zipper stop combination) or on a slider stop, for instance.

It should be noted that the absorbent panel 24 can be sold separately such that a consumer need only purchase one securing layer 22, but could have a number and variety of absorbent panels 24 so as to reduce the urgency of washing and reusing an individual absorbent panel 24, or for purely decorative reasons.

The present invention could also be sold as a crib sheet set, including bumper pads and the absorbent panel or panels 24, and optionally the securing layer 22, pillow cases, sconces, canopies, curtains, wall decorations and toys such as mobiles, etc. The bumper pads could have two decorative sides to match the two decorative sides of the panel 24, in a two-sided embodiment.

While a crib 10 is shown, it will be apparent that the present invention is useful for other types of beds, particularly but not limited to any bed that has side rails or structures closely adjacent to the mattress sides. But even without adjacent structures the present invention is useful in that the edges of a mattress 20 do not have to be lifted to change the insert panel 24 because it is not tucked under the mattress 20. Also, the relatively uniform thickness and lack of elastic bands makes the absorbent panel 24 easier to change than conventional fitted sheets when the bed remains occupied. The occupant is simply rolled to one side of the bed, the insert panel 24 unzipped half way around the bed and folded to cover the soiled spot if any and adjacent to the occupant, a new absorbent panel 24 is placed on the uncovered half of the top surface of the mattress 20, and then the occupant is rolled over onto the clean side of the bed. Completing the removal and replacement of the soiled insert panel 24 completes the process.

Additionally the present invention is useful even when the absorbent panel 24 is replaced with a sheet of material. While the user would not enjoy the benefit of an absorbent layer, the single layer could still have two different decorative sides, for example. Even as a single layer of material, this embodiment of the present invention is still be easier to change than conventional sheets because the mattress 20 does not have to be lifted at all to change the sheet, as explained above. Further, the absorbent panel 24 could have a separate function, such as an auxiliary feather mattress, whose primary purpose is to provide greater comfort to the bed occupant(s).

The present invention has been described by way of exemplary embodiments to which it is not limited. Variations and alterations will occur to those skilled in the art upon reading the above disclosure. Also, not all embodiments necessarily have any or all of the advantages mentioned about. While problems existing in the prior art can be solved by various embodiments of the present invention, not every embodiment of the present invention solves any or all of them. These alterations and variations are likely encompassed within the invention, as defined in the claims, appended below.

What is claimed is:

1. Bed clothing comprising:

a fitted sheet having four corners that are preformed to surround the corners of a mattress, and which includes an elastic band on an outer edge of the fitted sheet and extending therewith to secure the fitted sheet to the mattress;

a first portion of a continuous zipper mounted to the fitted sheet so that when the fitted sheet is secured to the mattress the first portion extends around all four sides of the outer periphery of the top edge of the mattress, the first portion defining a rectangle that is substantially the same size as a top surface of the mattress;

a multiple layer panel having substantially the rectangular shape defined by the first portion;

the panel having a second portion of a continuous zipper mounted to an outer perimeter of the panel, the first and second portions of the continuous zipper adapted to be fastened together in a single plane;

the fitted sheet and panel each include a tab of fabric configured to cover an exterior portion of the zipper;

wherein the panel includes a first outer decorative layer and a second outer decorative layer, and a moisture resistant layer positioned between the first and second outer decorative layers, and the zipper portions are structured so as to enable the panel to be selectively fastened to the fitted sheet with either of the two outer layers facing upward.

2. The bed clothing of claim 1, wherein the first outer layer of the panel includes a first applied decorative design and the second outer layer of the panel includes a second applied decorative design, and wherein the first and second applied decorative designs are different from each other.

3. The bed clothing of claim 1, wherein said first and second zipper portions are adapted to directly contact and interlock with each other in a single plane, such that movement between said fitted sheet and said panel is restricted in the direction force is transmitted therebetween.

4. The bed clothing of claim 1, wherein further comprising a slider that includes a slide securing device that restricts the occupant from dissociating said first zipper portion and said second zipper portion from each other.

5. The bed clothing of claim 4, wherein said securing device is a lanyard having a length sufficient to be fastenable to either said fitted sheet having a mating securing device at a position an occupant on the mattress cannot easily reach or a bed structure at a position an occupant on the mattress cannot easily reach.

6. The bed clothing of claim 1, wherein said panel is an absorbent panel.

7. Bed clothing of claim 1, wherein said panel is washable and reusable.

8. Bed clothing of claim 1, wherein said panel is disposable.

* * * * *